US007077059B1

(12) United States Patent
Cobb

(10) Patent No.: US 7,077,059 B1
(45) Date of Patent: Jul. 18, 2006

(54) PORTABLE APPARATUS FOR COMPACTING AND STORING CIGARETTE BUTTS

(76) Inventor: Johnny Cobb, 102 Sunset Ter., Amarillo, TX (US) 79106

( * ) Notice: Subject to any disclaimer, the term of this patent is extended or adjusted under 35 U.S.C. 154(b) by 0 days.

(21) Appl. No.: 10/997,673

(22) Filed: Nov. 26, 2004

(51) Int. Cl.
*B30B 1/00* (2006.01)
*B02C 1/00* (2006.01)

(52) U.S. Cl. ..... 100/227; 100/245; 100/266; 241/169; 241/183

(58) Field of Classification Search ..... 100/54, 100/179, 214, 215, 218, 227, 228, 240, 245, 100/260, 266, 906; 241/169, 283
See application file for complete search history.

(56) References Cited

U.S. PATENT DOCUMENTS 3,017,822 A * 1/1962 Hawley ..... 100/240
3,602,136 A * 8/1971 Ligh ..... 100/345
3,888,264 A 6/1975 Baclit
3,889,587 A * 6/1975 Wharton ..... 100/98 R
4,095,459 A * 6/1978 Feldt ..... 73/76
4,252,237 A 2/1981 Baclit
4,286,515 A 9/1981 Baumann et al.
4,345,519 A * 8/1982 Sabino ..... 100/215
RE31,076 E 11/1982 Herman
4,961,496 A 10/1990 Focke et al.
5,368,155 A 11/1994 Ewen
5,673,709 A 10/1997 Brothers
5,711,423 A 1/1998 Fuller, Jr.

* cited by examiner

*Primary Examiner*—Derris H. Banks
*Assistant Examiner*—Jimmy T. Nguyen
(74) *Attorney, Agent, or Firm*—Norman Rainer

(57) ABSTRACT

An apparatus for compacting and storing cigarette butts includes a housing having a central bore with a releasable bottom closure, a closable upper extremity, and a plunger which can be forced downwardly to compact butts within the bore. The plunger also serves as releasable closure for the upper extremity of the bore.

13 Claims, 4 Drawing Sheets

PORTABLE APPARATUS FOR COMPACTING AND STORING CIGARETTE BUTTS

BACKGROUND OF THE INVENTION

1. Field of the Invention

This invention concerns apparatus for the convenient and safe accumulation of cigarette butts, and more particularly relates to apparatus to be carried by a cigarette-smoking person for safely accumulating cigarette butts prior to proper disposal thereof.

2. Description of the Prior Art

When cigarettes are smoked, an unconsumed portion remains, said portion consisting of a filter, a small amount of tobacco rod, and the paper outer wrap that joins the filter to the tobacco rod. Said unconsumed portion is generally referred to as a butt or stub. When outdoors, there is the tendency for the smoker to discard the butt onto sidewalks, streets, fields or wherever else might be most convenient or inconspicuous. When indoors, the cigarette butts are often discarded onto the floors of stores, public buildings, malls and auditoriums.

The large numbers of carelessly discarded cigarette butts constitutes a significant litter problem. It should also be noted that, if the butt is not extinguished prior to disposal, it represents a fire hazard. The butts are hazardous to marine and terrestrial species that might ingest them, and cause difficulties in stormwater filtration systems.

Several expedients have earlier been proposed for enabling a smoker to easily and safely accumulate cigarette butts for ultimate disposal in an acceptable manner. Such expedients generally involve small collecting devices which can be associated with a cigarette lighter or package of cigarettes, and which have a capacity of 5 to 20 butts.

U.S. Pat. RE. 31,076 discloses a plastic cigarette package having a plurality of bores that receive cigarette butts. When filled with butts, the package is returned to a retail outlet for return of a deposit initially paid by the smoker.

U.S. Pat. No. 5,673,709 describes a portable ashtray having an apertured top portion which allows passage of a butt to a lower receptacle portion. The top portion is removable to permit dumping of accumulated butts.

U.S. Pat. No. 5,368,155 discloses a cigarette package having a butt-receiving drawer and means for slidably accommodating a cigarette lighter.

U.S. Pat. No. 5,711,423 concerns a rigid container having separate compartments for an easily crushable package of cigarettes, and cigarette butts. As the cigarettes are transformed into collected butts, the butt compartment is caused to increase in volume while causing commensurate diminution of the volume of the cigarette package compartment.

U.S. Pat. No. 3,888,264 discloses a holder for accommodating a cigarette package. A slidably removable ashtray receptacle is built into the bottom of the holder.

U.S. Pat. No. 4,961,496 describes a cigarette package having a deformable partition which divides the package into separate compartments for cigarettes and butts.

U.S. Pat. No. 4,252,237 concerns a combination holder including separate compartments for a package of cigarettes, a cigarette lighter and cigarette butts.

U.S. Pat. No. 4,286,515 describes a compacting waste basket having a hinged lid that can exert downward force upon debris within a collecting compartment.

Although the aforesaid patents address the issue of disposing of cigarette butts in a thoughtful manner, the disclosed devices are either difficult to use, or of such large size as to be inconvenient to carry, or lacking in versatility because of requisite use with only certain kinds of cigarette packages.

It is accordingly an object of the present invention to provide a small-sized apparatus for the easy accumulation and subsequent disposal of cigarette butts.

It is another object of this invention to provide apparatus as in the foregoing object which is optionally attachable to a cigarette lighter.

It is a further object of the present invention to provide apparatus of the aforesaid nature amenable to single handed operation.

It is an additional object of this invention to provide apparatus of the aforesaid nature capable of compacting cigarette butts so as to achieve greater butt-accumulating capacity within a relatively small compartment.

It is a still further object of the present invention to provide apparatus of the aforesaid nature which safely extinguishes cigarette butts, prevents inadvertent release of ashes, and permits easy and efficient discharge of accumulated butts.

These objects and other objects and advantages of the invention will be apparent from the following description.

SUMMARY OF THE INVENTION

The above and other beneficial objects and advantages are accomplished in accordance with the present invention by an apparatus for compacting and storing cigarette butts comprising:

a) a housing elongated between upper and lower extremities,
b) a bore of uniform cross-sectional configuration within said housing extending between and opening upon said upper and lower extremities,
c) plunger means for exerting compressive force upon cigarette butts entered into said bore from said upper extremity, and for additionally serving as an adjustable closure lid for said upper extremity,
d) restoring means for returning said plunger means to said upper extremity, and
e) adjustable closure means for said lower extremity.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
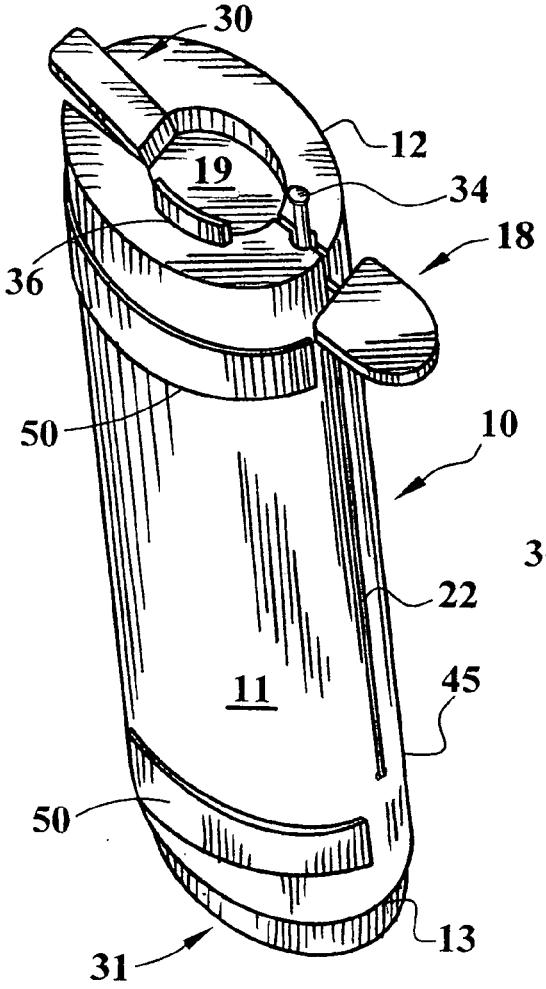
FIG. 1 is a perspective top and side view of an embodiment of the apparatus of this invention, shown in its closed state.
Figure 2:
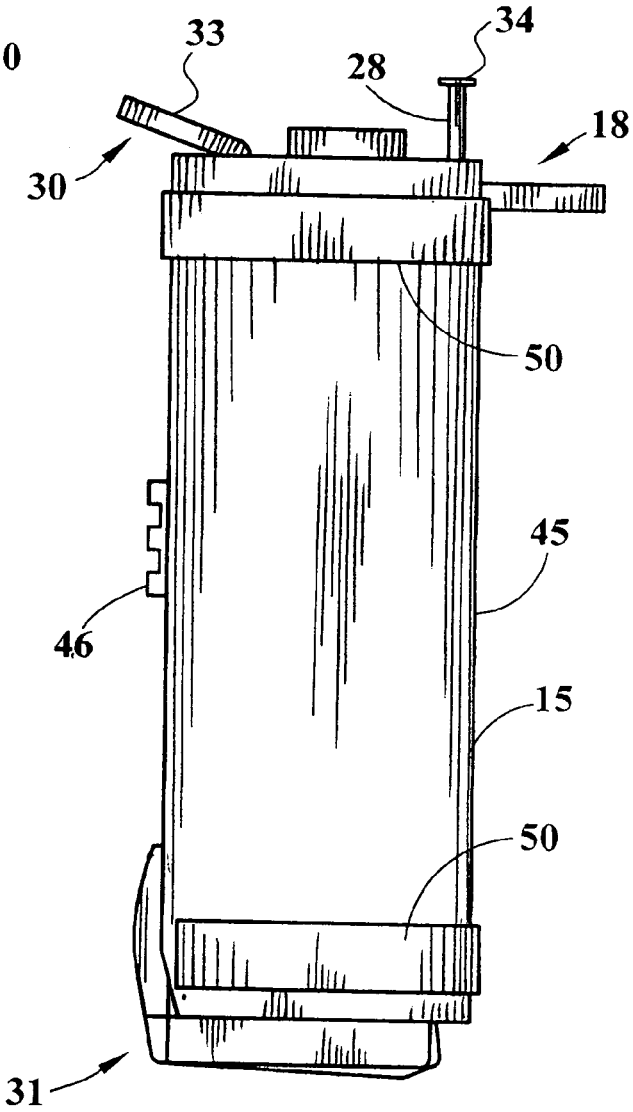
FIG. 2 is a side view of the embodiment of FIG. 1.
Figure 3:
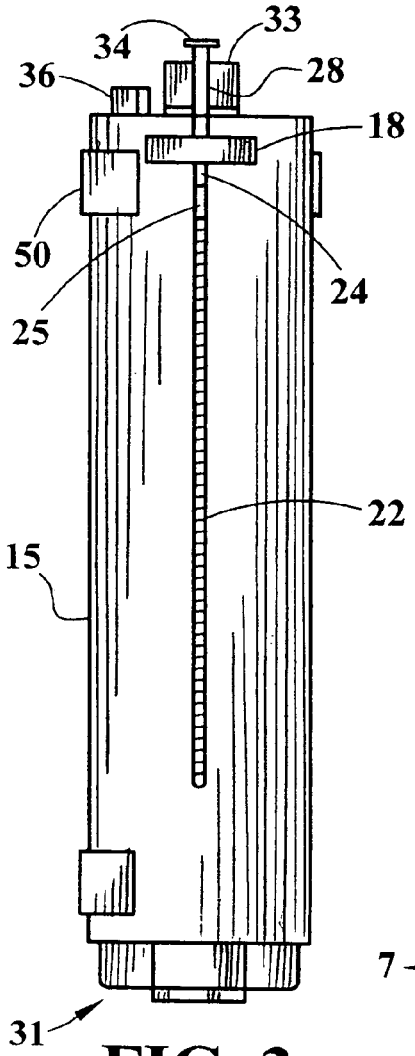
FIG. 3 is a front view thereof.
Figure 4:
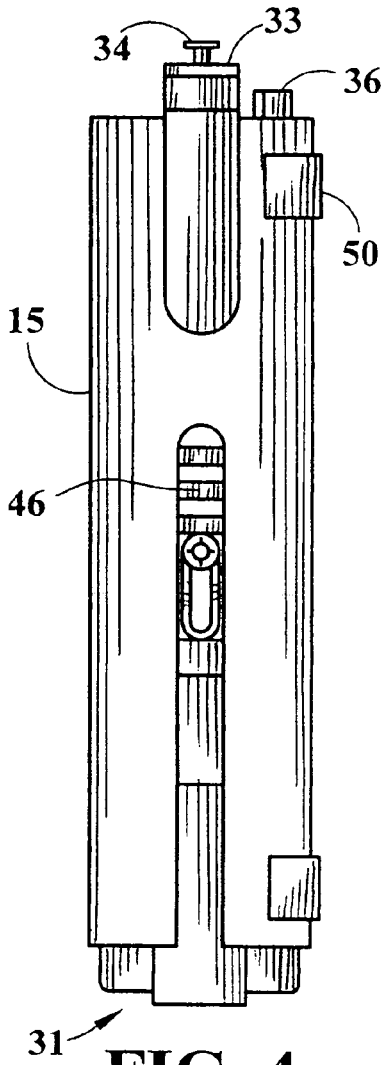
FIG. 4 is a rear view thereof.

Referring now to FIGS. 1–10, an embodiment of the apparatus 10 of the present invention is shown comprised of housing 11 elongated between upper and lower extremities 12 and 13, respectively, and containing bore 14 of uniform cross-sectional configuration which opens upon said upper and lower extremities. Adjustable bottom closure means 31 are interactive with said bore at said lower extremity. For reasons of clarity of illustration, FIGS. 1–10 are larger in size than the actual apparatus.

The external appearance of the exemplified housing, as defined by outer sidewall surface 15, is oval-shaped. Other external configurations may, however, be employed, preferably being symmetrical with respect to the center axis 16 of bore 14. Said housing may be of metal or plastic construction, and may typically have a length, measured between said extremities, of between about 65 and 80 millimeters.

Plunger means 18 is associated with upper extremity 12. The exemplified plunger means is shown having a plunger portion 19 whose outer perimeter 26 is adapted to make close-fitting sliding contact with bore 14, and a finger grip portion 20 positioned to slide axially along sidewall surface 15. Said plunger and finger grip portions are joined by a thin connecting member 21 adapted to undergo reciprocating sliding movement within an axially directed slot 22 communicating between bore 14 and sidewall surface 15 at the front surface 45 of said housing. Said connecting member contains a tubular bushing 24 adapted to slidably embrace guide rod 25 which is emplaced within slot 22, and extends from lower extremity 13 to upper end portion 28 disposed above upper extremity 12 and equipped with retaining flange 34. A coil spring 29 mounted upon said guide rod serves to urge said plunger means upwardly upon the guide rod.

By virtue of the aforesaid construction, finger-applied downward force acting upon finger grip portion 20 causes plunger portion 19 to descend within bore 14 to compact any cigarette butt within said bore. Upon release of the downward force, said plunger means is restored to its uppermost position, where it serves as a closure lid which prevents loss of material upwardly from said bore.

Latch means 30 is pivotably associated with said housing and comprised of an action lever 33 terminating in a control nose 48 disposed above bore 14. Said lever 33 is biased toward bore 14 by spring 32. Nose 48 is shaped such that it intercepts and secures plunger portion 19 upon spring-urged upward motion thereof, preventing movement out of bore 14. However, nose 48 permits forceful downward passage of said plunger portion into bore 14 from a site located above upper extremity 12. Said permitted downward passage is achieved, for example, by virtue of a bearing surface 49 downwardly angled toward said bore. By virtue of such effect, plunger portion 19 is caused to further serve as a top closure lid which prevents inadvertent discharge of the contents of the bore.

Figure 8:
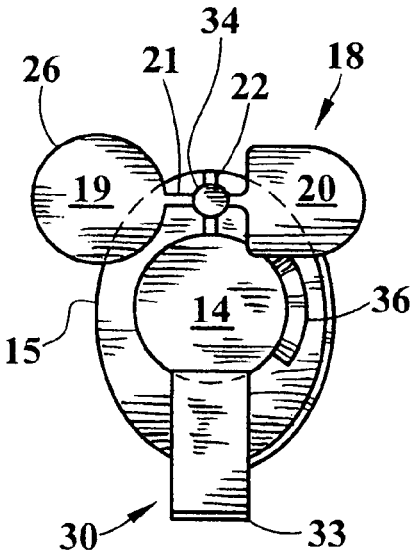
FIG. 8 is a top view of the embodiment of FIG. 1 shown in its open, butt-receiving state.
Figure 9:
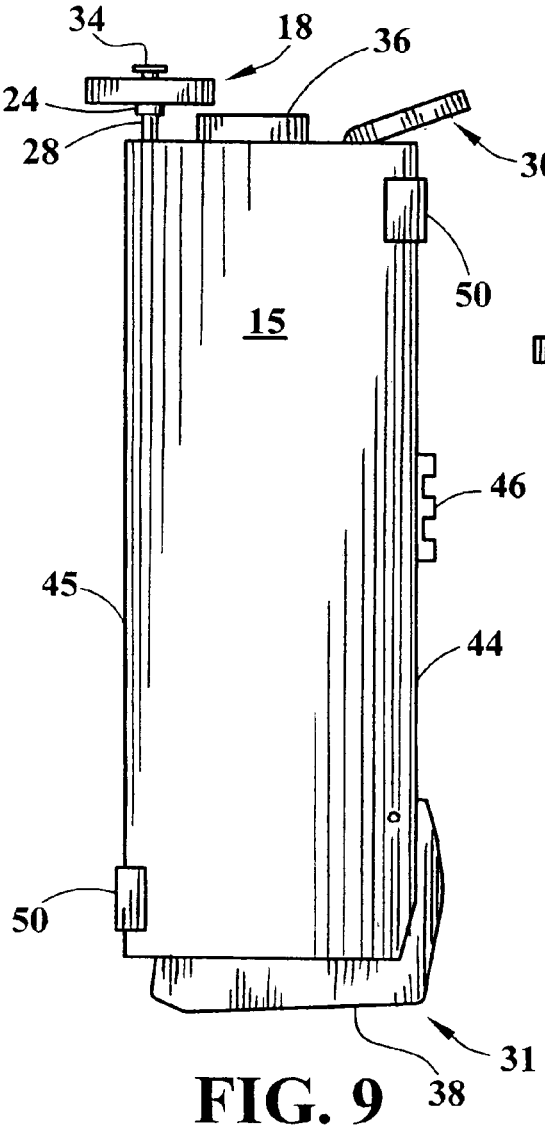
FIG. 9 is a side view of the apparatus in its open, butt-receiving state.

In operation, when it is desired to enter a cigarette butt into bore 14, lever portion 33 of latch 30 is depressed, producing pivoted outward motion of latch 30 with attendant release of plunger means 18. Spring 29 consequently drives said plunger means out of bore 14 and above upper extremity 12. Upward movement of said plunger means is halted by retaining flange 34 atop guide rod 25, said uppermost site of halted movement being about 2 millimeters above upper extremity 12. When at said uppermost site, bushing 24 enables plunger means 18 to be pivoted freely about upper portion 28 of rod 25 within a plane orthogonal to axis 16 to a position clear of bore 14 (as shown in FIGS. 8 and 9).

When a cigarette butt is entered into the open upper extremity of bore 14, plunger means 18 is then manipulated so as to pivotably return plunger portion 19 to a position above bore 14. Abutment means 36 may be employed to stop the pivoted movement of said plunger means at the exact position which centers plunger portion 19 above bore 14. Finger pressure is then applied to finger grip portion 20 of said plunger means, causing plunger portion 19 to pass nose 48 and compact butts within bore 14.

Figure 10:
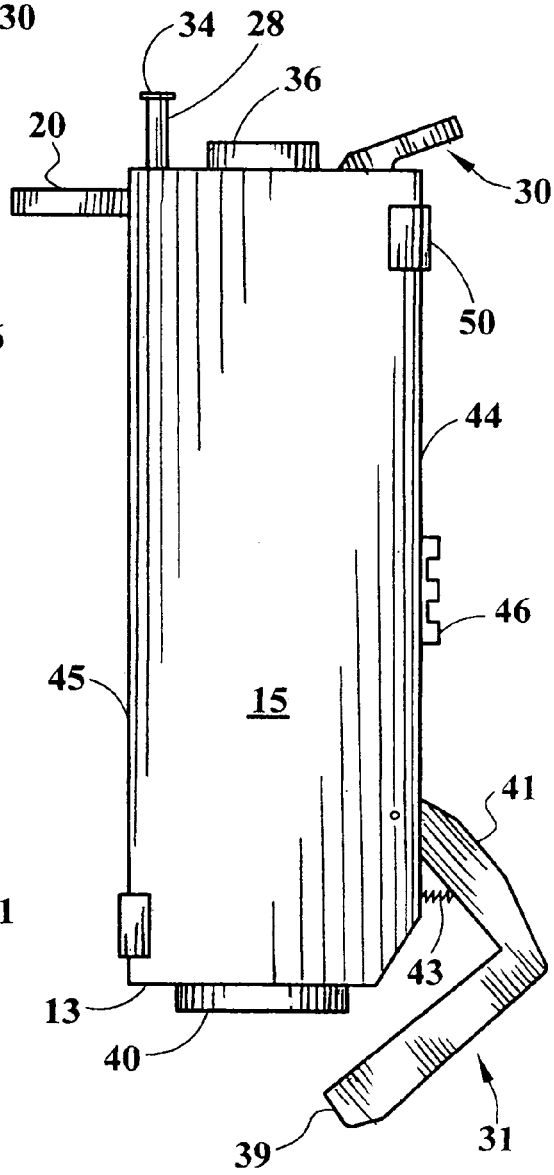
FIG. 10 is a side view of the apparatus in its butt-discharging state.

After the successive addition of 3 to 6 cigarette butts, bore 14 may become filled. The contents of the bore may then be discharged by proper manipulation of bottom closure means 31. In the illustrated embodiment, said bottom closure means is comprised of a cap component 38 having a retaining perimeter lip 39. Said lip is adapted to closely embrace a shoulder 40 of bore 14 that protrudes downwardly about 1 millimeter from lower extremity 13. An action arm 41 emergent from the perimeter of cap 38 extends to pivoted engagement with the housing at rear surface 44 thereof. A spring 43 interactive between arm 41 and said housing biases cap 38 away from bore 14. Latch means 46 slidably retained within the rear surface 44 of the housing is adapted to secure arm 41 in the closed state of the device (as shown in FIGS. 1–9), thereby preventing inadvertent discharge of the contents of the bore. When disposal of the confined butts is desired, latch means 46 is slid by finger force to its release position, an upward position in the exemplified embodiment. Cap 38 is then swung by finger manipulation to a pivoted location away from the housing, as shown in FIG. 10, thereby opening bore 14 for discharge of its contents.

Figure 5:
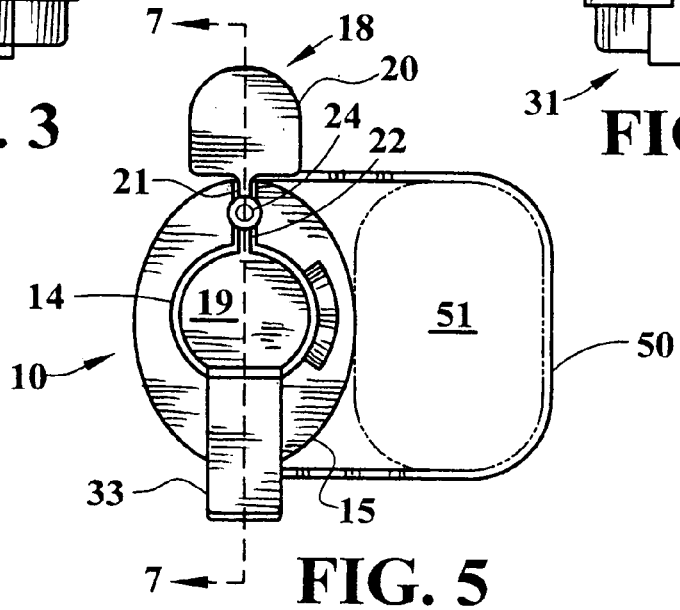
FIG. 5 is an enlarged top view thereof.
Figure 6:
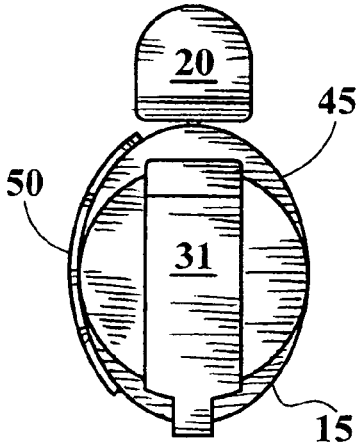
FIG. 6 is a bottom view thereof.
Figure 7:
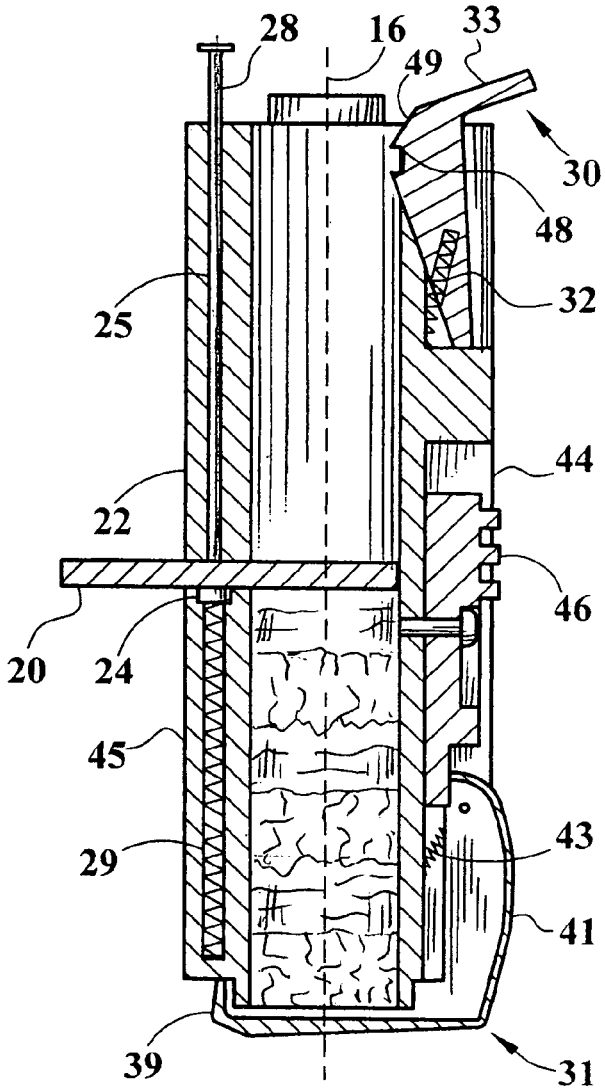
FIG. 7 is a sectional view taken in the direction of the arrows upon the line 7—7 of FIG. 5.

Attachment means, shown as rubber bands 50 in the illustrated embodiment, facilitate releasable attachment to a cigarette lighter 51, as shown in FIG. 5 in phantom outline.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. Apparatus for compacting and storing cigarette butts comprising:

a) a housing elongated between upper and lower extremities, and bounded by a sidewall surface, b) a bore having a straight center axis and uniform cross-sectional configuration within said housing extending between and opening upon said upper and lower extremities, c) plunger means for exerting compressive force upon cigarette butts entered into said bore from said upper extremity, and for additionally serving as an adjustable closure lid for said upper extremity, said plunger means having a plunger portion having a perimeter which makes close-fitting sliding contact with said bore, and a finger grip portion positioned to slide axially along said sidewall surface, d) restoring means for returning said plunger means to said upper extremity, and e) adjustable closure means for said lower extremity.

2. The apparatus of claim 1 wherein said sidewall surface has a substantially symmetrical shape with respect to the axis of said bore.

3. The apparatus of claim 2 wherein said sidewall surface is oval-shaped.

4. The apparatus of claim 1 wherein said plunger and finger grip portions are joined by a thin connecting member.

5. The apparatus of claim 4 further comprising an axially directed slot communicating between said bore and sidewall surface and confining said connecting member for reciprocating sliding movement.

6. The apparatus of claim 5 wherein said slot contains a guide rod which extends from said lower extremity to an upper end portion disposed above said upper extremity.

7. The apparatus of claim 6 wherein a retaining flange is positioned atop said upper end portion.

8. The apparatus of claim 7 wherein said connecting member includes a tubular bushing adapted to slidably embrace said guide rod.

9. The apparatus of claim 7 further comprising a coil spring mounted upon said guide rod and serving to urge said plunger means upwardly upon said guide rod.

10. The apparatus of claim 1 further comprising latch means pivotably associated with said housing for the purpose of controlling the position of said plunger means.

11. The apparatus of claim 10 wherein said latch means has a control nose that intercepts and secures said plunger means upon upward motion thereof but allows downward motion thereof from a location above said upper extremity.

12. The apparatus of claim 6 wherein said plunger means is adapted to pivot about the upper end portion of said guide rod between a position wherein said plunger portion is centered above said bore and a position where said plunger portion is clear of said bore.

13. The apparatus of claim 1 further provided with means for releasibly embracing a cigarette lighter.

* * * * *